US006676430B1

(12) United States Patent
Conorich

(10) Patent No.: US 6,676,430 B1
(45) Date of Patent: Jan. 13, 2004

(54) BOARD MOUNTED JACK MODULE

(75) Inventor: Theodore A. Conorich, Lake Hiawatha, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/577,273

(22) Filed: May 23, 2000

(51) Int. Cl.[7] ..... H01R 4/50
(52) U.S. Cl. ..... 439/341
(58) Field of Search ..... 439/341, 61, 376; 361/788, 784, 796, 785; 1/924.1

(56) References Cited

U.S. PATENT DOCUMENTS 3,436,715 A * 4/1969 Matthews ..... 439/341
4,034,284 A * 7/1977 Peplow et al. ..... 324/508
4,941,837 A * 7/1990 Nakamura ..... 439/341
5,378,169 A * 1/1995 Volz et al. ..... 439/376
5,492,478 A * 2/1996 White ..... 439/76.1
5,982,634 A * 11/1999 Wronski ..... 361/788
6,332,795 B1 * 12/2001 Conorich ..... 439/188
6,358,080 B1 * 3/2002 Conorich ..... 439/341

* cited by examiner

*Primary Examiner*—Ross Gushi
(74) *Attorney, Agent, or Firm*—Birch, Stewart, Kolasch & Birch LLP

(57) ABSTRACT

A connector system with a printed wiring board to which a board mounted jack module is attached, and a back plane. The printed wiring board is attached almost perpendicularly to the back plane. Each jack attached to the wiring board has a rotatable end and when engaged with a corresponding plug, a fulcrum is created. The plug when rotated around the fulcrum point achieves a connection, and the ease of the snap-in and the hinging mechanism enable simple and reliable connections to be made. Also included on the jack is a label surface that is on the outward facing surface with all the cord connections occurring behind the label surface.

11 Claims, 6 Drawing Sheets

BOARD MOUNTED JACK MODULE

RELATED APPLICATIONS

The present patent application is related to U.S. patent application Ser. No. 09/575,969, entitled, "HINGED CONNECTION SYSTEM", being concurrently filed herewith and having a filing date of May 23, 2000,; U.S. patent application Ser. No. 09/577,274, entitled, "CONTACTS FOR HINGED CONNECTION SYSTEM", being concurrently filed herewith and having a filing date of May 23, 2000,; to U.S. patent application Ser. No. 09/575,902, entitled, "CONNECTOR SYSTEM WITH RELEASABLE LATCH", being concurrently filed herewith and having a filing date of May 23, 2000,; to U.S. patent application Ser. No. 09/577,275, entitled, "SNAP-IN MODULE SYSTEM", being concurrently filed herewith and having a filing date of May 23, 2000,; to U.S. patent application Ser. No. 09/575,968, entitled, "SLIDING CABLE FIXTURE", being concurrently filed herewith and having a filing date of all of May 23, 2000,; all of which have a common inventor and assignee and being incorporated herein by reference.

FIELD OF THE INVENTION

The present invention relates generally to electrical connection systems, and more particularly, to modularized electrical connection systems.

BACKGROUND OF THE INVENTION

In the telecommunications industry, connecting systems comprising an array of insulation displacement contacts (IDC) are typically used in telephone company central offices for electrical connection between cables and cross-connect wiring. These electrical connection systems are used throughout the telecommunications industry in order to interconnect corresponding wires in two sets of wires. The predominant connecting systems for building terminal cross-connect systems are currently the modular RJ45 connector system and the 110 connection system or variations of these connection systems. The modular type connector systems use a plug and jack type interface for making connections.

The RJ45 version of a modular connector system is a 4-pair patch cord based connector system that cannot be broken down to smaller increments without wasting connector positions. A patch cord connection is made to a jack by deflecting a set of cantilevered spring wires in a jack with a mating set of fixed pressure contact surfaces in the plug, as the plug is pushed into the jack with a relatively low force. As the plug completes its insertion into the jack, it automatically latches with an audible click. By gripping the exposed back end of the plug, and depressing a lever, the latch can be released. The spring loaded wire contacts within the jack essentially push the plug out. The RJ45 modular systems have a panel with a flat front face which forms the connector plane. When a patch cord is installed, the cordage comes straight out from the panel. Cross-connect distribution rings bring the cordage back in along the face of the panel. Cables are connected to the RJ45 connectors in contacts having insulation displacement positions that are typically mounted either on the back of the connector plane, or on the back of modules that must be mounted into the connector plane, after cable termination.

The 110 Connector System is designed with insulation displacement connections for both the cable connections and the cross-connect or patching connections. Therefore, a patching connection can be made by terminating cross-connect wires in the contacts IDC slots, or by inserting patch cord blades into those same contact slots.

This Connector System forms a connector field that is front accessible, and is designed for wall mounting. Despite this design, the 110 system can be frame mounted, with the cables fed from the front in a manner similar to wall mounting. The cables can also be fed from the back of the frame. The front access is achieved by having a cross-connect field superimposed on a cable termination field; that is, superimposed on the cable routing. Cables are routed behind the wiring blocks, either in pre-mounted channels or between the rows of wiring block support legs. Cable ends are brought through their appropriate openings in the wiring block to the cable termination surface, and the exposed cable sheath is removed. The cable conductors are fanned out as twisted pairs to their appropriate termination ports in the index strips on the front face of a wiring block.

Connecting blocks, which include contacts having insulation displacement portions on two opposite ends, are brought down and snapped onto the index strip to form electrical connections between the contacts and conductors. The front surface formed by the connecting blocks is the cross-connect field. A designation strip is placed between alternate rows and is used to label the conductor terminations on the rows on either side of it. When a cross-connect field is intended for use with patch cords, 100 pair wiring blocks typically alternate with horizontal troughs, with patch cords from the upper 2 rows going into an upper trough, and patch cords from the lower 2 rows going into a lower trough. When a high percentage of patch cord positions are populated, the patch cord connectors present an unruly appearance and the labeling becomes very difficult to read, making cord location a time consuming process.

Patch cords in the 110 Connector System have contact blades that make connection by inserting into the top IDC slots of the contact elements. The IDC are designed to remove insulation as it makes contact, and achieve a high enough contact force to make a stable long term connection to unplated wire. Repeated insertions, of the patch cord blades, past this entrance geometry, with its high contact force, reduces the life of the patch cord blades protective plating. This contact force (about 2 pounds) holds the patch cord blade by friction and prevents it from sliding out by about a third of a pound per contact. The contact slots are tapered so any vibration or wiggling of the patch cord would cause the blades to slowly walk out of the slots, unless something else held them in place.

Connecting blocks may have hemispherical buttons that match mating holes in the patch cords. By pulling on a patch cord, the side walls on the plug end flex as they slide over the connecting blocks buttons, a snap-on/snap-off type of latch is enabled and the plug end is disconnected. The force to overcome this latch and remove a 4-pair patch cord, with a straight pull, can be as high as 25 pounds. Removal can be effected by a side to side rocking of the patch cord. Because patch cord plugs are in close proximity to each other, removal of one patch cord can easily result in the dislodging of a neighboring patch cord. Therefore, technicians must be very deliberate and careful during cord tracing to avoid inadvertently dislodging a patch cord. Furthermore, the high friction on the connecting block's buttons can cause extensive wear of the surfaces so that the retention capability of the connecting blocks degrades after multiple insertions and removals.

SUMMARY

An electrical connector system that includes a printed wiring board, a plurality of jacks attached to the printed wiring board, and a backplane. The printed wiring board is attached almost perpendicularly to the back plane. Each jack attached to the wiring board has a rotatable end and when engaged with a corresponding plug, a fulcrum is created. The plug when rotated around the fulcrum point achieves a connection, and the ease of the snap-in and the hinging mechanism enable simple and reliable connections to be made.

In an exemplary embodiment, the jack on the printed wiring board includes a label surface on its outward facing surface and all cord connections occur behind this label surface. Thus, with all cordage behind the label surface, an unobstructed view of the label surface is provided, permitting fast and accurate identification of all jack terminations.

Advantageously, the printed wiring board provides the main structural support for the jacks and functions as trough side walls, in addition to conducting and modifying the electrical signals from the jacks to the cable connections at the back plane.

BRIEF DESCRIPTION OF THE DRAWINGS

A more complete understanding of the present invention may be obtained from consideration of the following description in conjunction with the drawings, in which:

FIG. 5(*b*) is a partial, cross-sectional top view of a jack and a four pair patch cord plug in accordance with the present invention.

DETAILED DESCRIPTION

Figure 1A:
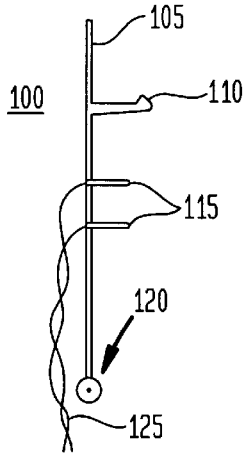
FIGS. 1(*a*)–1(*e*) are schematic diagrams of a plug and a jack.
Figure 1B:
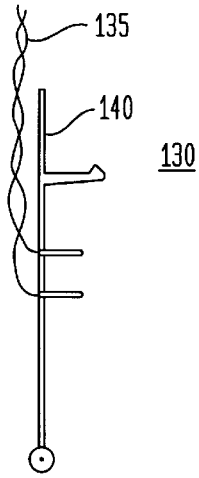
Figure 1C:
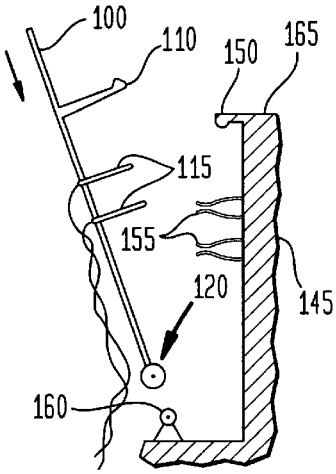
Figure 1D:
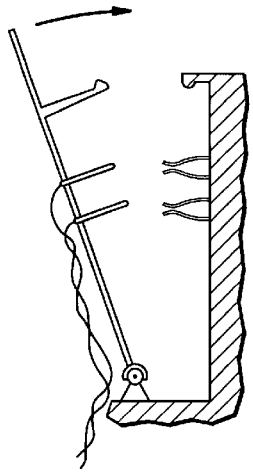
Figure 1E:
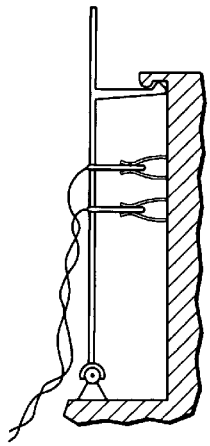

The principal concept of the cross-connect system is based on having one end of a plug hooking onto a corresponding end of a jack to form a fulcrum. The plug then functions as a lever by rotating about that fulcrum until it mates with the jack.

A plug 100 is illustrated in FIG. 1(*a*). The plug 100 includes a handle 105 on one end. When the plug 100 functions as a lever, the handle 105 serves as one end of that lever. The other end of that lever is the plug fulcrum section 120. The plug 100 further includes a latch 110 that it is located proximate to the handle 105. The latch extends somewhat perpendicularly from the plug 100. A pair of contacts 115 are located between the latch 110 and the plug fulcrum section 120. Cordage 125 is electrically connected to the contacts 115. Although one pair of contacts 115 is shown in the plug 100, it is understood that any plurality of contacts can be included within a plug 100.

In one embodiment of the invention, cordage 125 exits plug 100 at plug fulcrum section 120. As such, cordage 125 automatically heads toward a back plane (not shown) and is inside a trough (as detailed in FIGS. 2 and 3(*a*)–(*c*)). This keeps the immediate area clear of cordage 125, thereby providing a much neater appearance and making it easier for the craftsperson to locate specific jack positions. Also, because the cordage 125 does not come straight out, it is much harder to affect the latch engagement when cordage 125 is manipulated for cord tracing, as an example. Latching in this configuration can be implemented using a snap action latch mechanism.

Referring now to FIG. 1(*b*), a plug 130 can also have cordage 135 exit at a handle 140. Since cordage 135 heads away from the back plane in this instance, care must be taken to keep cordage 135 from interfering with patch cord installation or removal. A wider trough may be required and a positive latch with a release mechanism may be required. The remaining illustrations and description employ a snap action latch, however, a positive latch with a release mechanism could also be used.

Referring now to FIGS. 1(*c*)–1(*e*), mating of plug 100 to a jack 145 is illustrated. As shown in the figures, jack 145 includes a corresponding latch 150, corresponding contacts 155 and a jack fulcrum section 160. Referring specifically to FIG. 1(*c*), plug fulcrum section 120 engages jack fulcrum section 160. The angle of engagement is sufficiently offset to prevent engagement of latch 110 with corresponding latch 150 and contacts 115 with corresponding contacts 155. Engagement of the latches is prevented until the fulcrum sections 120 and 160 are fully engaged and the plug rotated towards the jack. In one embodiment, this offset angle or rotation angle is approximately 20°. Referring now to FIGS. 1(*d*) and 1(*e*), handle 105 is used as a lever to rotate plug 100 towards jack 145 until corresponding latch and contact connection is achieved.

As illustrated in FIG. 1(*c*), corresponding latch 150 further includes a label surface 165. One of the advantages of the cross connect system is that label surface 165 is positioned frontward as shown below and the resulting connection is implemented behind or below label surface 165. This implementation maximizes the area in the cross connect field that can be devoted to either the label or trough space. This advantage is shown in more detail with respect to FIGS. 2 and 3(*a*)–3(*c*).

Figure 4:
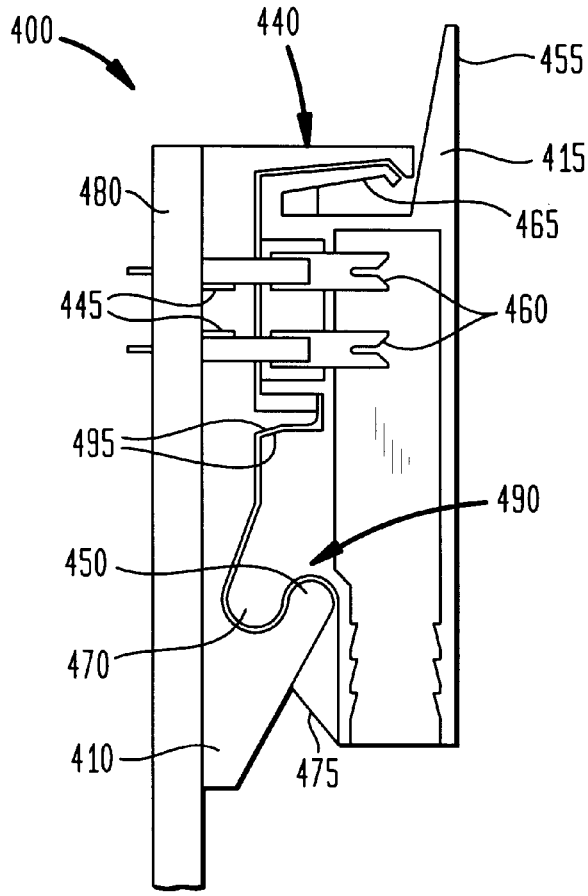
FIG. 4 is a side cross sectional view of a mated plug and jack.

Referring to FIG. 4, the preferred embodiment of a cross connect system 400 is displayed. Specifically, FIG. 4 displays in detail the cross connect system 400 in the board mounted jack module configuration where the jack 410 is connected onto the printed wiring board 480. The cross connect system 400 consists of a jack 410, plug 415, and printed wiring board 480.

A jack 410 is a 4-pair jack that has a label surface 440 and jack contacts 445. Jack 410 further includes a fulcrum point 450. Jack 410 further includes a first arc surface 490, concentric with fulcrum point 450, which engages a mating surface 490 on plug 415 for rotatably connecting plug 415 with jack 410. Jack 410 further includes a second arc surface or guide surface 495, also concentric with fulcrum point 450, which engages with a mating surface 495 on plug 415 only after plug 415 has started rotating into engagement with jack 410. This second arc surface 495 keeps plug 415 constrained to a well controlled arc trajectory engagement path as plug 415 engages with jack 410.

Referring still to FIG. 4, plug 415 includes a handle 455, plug contacts 460, a latch 465, a rounded hook 470 and an anti-snag rib 475 that prevents the plug hook from snagging on cables as the jack is installed or removed.

Figure 5A:
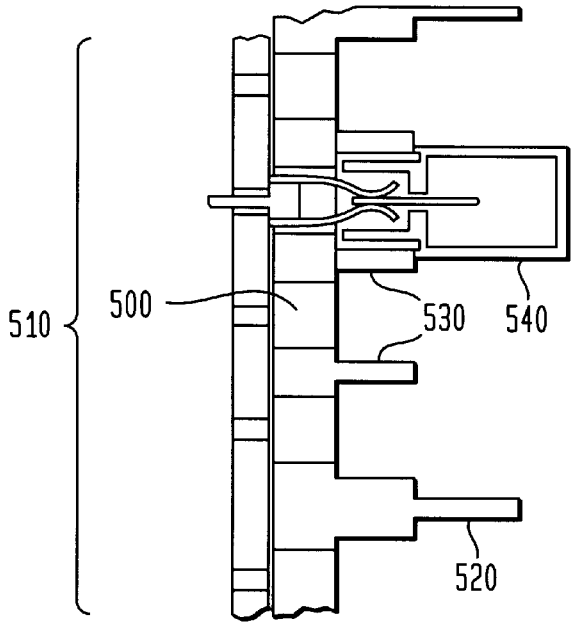
FIG. 5(*a*) is a partial, cross-sectional top view of a mated jack and a one pair patch cord plug in accordance with the present invention.
Figure 5B:
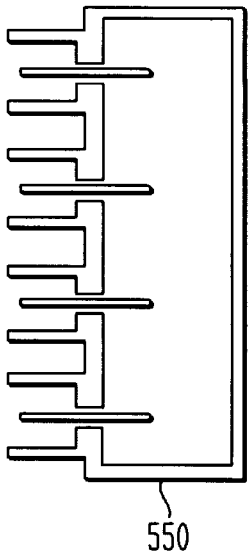

As illustrated in FIGS. 5(*a*) and 5(*b*), the jacks of the present invention permit connections with plugs of different sizes, varying from 1-pair to 4-pair. Referring to FIG. 5(*a*), a jack 500 has at least one 4-pair connection site 510. Jack 500 includes a partitioning wall 520 after every 4-pair connection sites 510. Partitioning walls 520 prevent plugs from crossing over and making connections to contacts in 2 jacks simultaneously. Each 4-pair connection site further includes guide walls 530. Each site 510 can accommodate a single plug 540, a 4-pair plug 550, as shown in FIG. 5(*b*), or any pair size in between.

Figure 2:
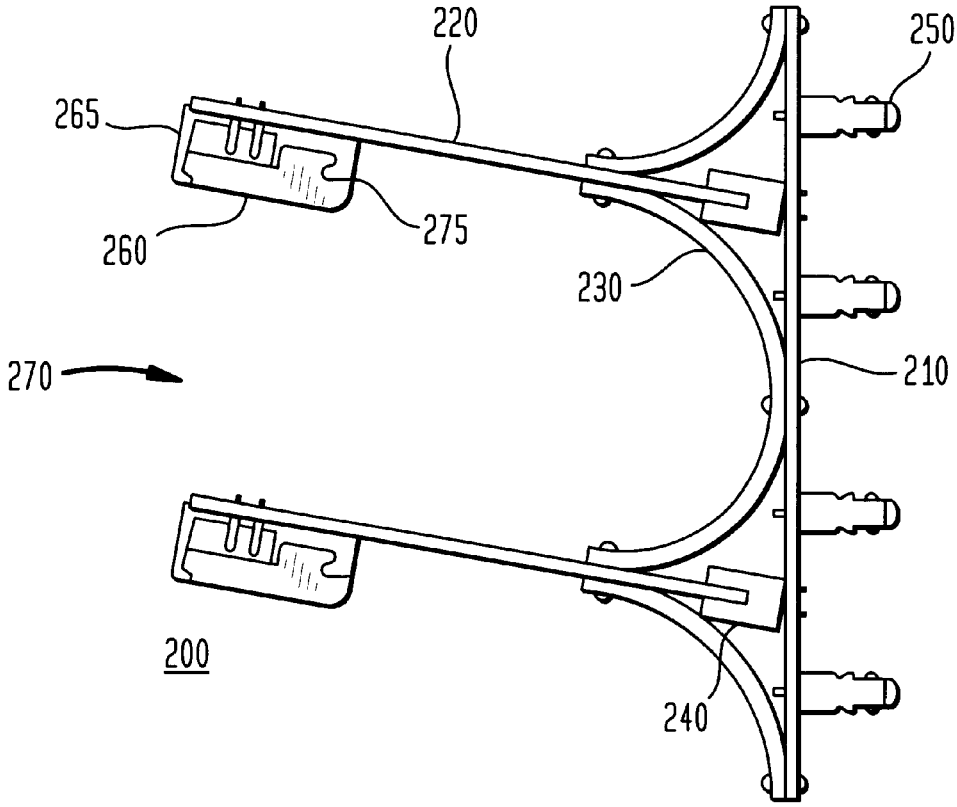
FIG. 2 is a side cross sectional view of a jack mounted on a printed wiring board support structure in accordance with the present invention.

Referring to FIG. 2, a cross sectional view of a printed wiring board utilizing the board mounted jack module with the cross connect system is shown. Cross connect system 200 has a backplane printed wiring board 210 and at least one printed wiring board 220 connected to board 210 using support structures 230 and edge card connectors 240. Connection blocks 250 with insulation displacement contacts for example are attached to board 210 to permit connections with conductors of cables that go to, for example, equipment or wall jacks (not shown). Specifically, a jack 260 is connected to board 220. Importantly, jack 260 has a label surface 265 that faces away from board 210.

Also, additional printed wiring boards (see FIG. 2) can be connected parallel to each other and sticking out from the backplane. FIG. 2 illustrates two parallel printed wiring boards 220 connected to the backplane 210 at an angle of approximately 90 degrees, i.e. approximately perpendicular to the backplane 210. However, these printed wiring boards can be connected to the backplane at a 10 degree angle (not shown). Attaching the printed wiring board at a 10 degree angle provides for easier manipulation of the jack and plug. In addition, it makes for improved viewing of the label on the end of the jack surface, because the person viewing label is more often reading labels that are below eye level.

Similar to FIG. 1(*e*), the connection between a plug and the jack 260 is made below the label surface 265. If cross connection system 200 further utilizes a scheme where cordage exits at a fulcrum end 275 towards the backplane 210 and into a trough 270, then the only visible object beyond label surface 265 is the relatively small handle of the plug. This is clearly shown in FIGS. 3(*a*)–3(*c*).

Figure 3A:
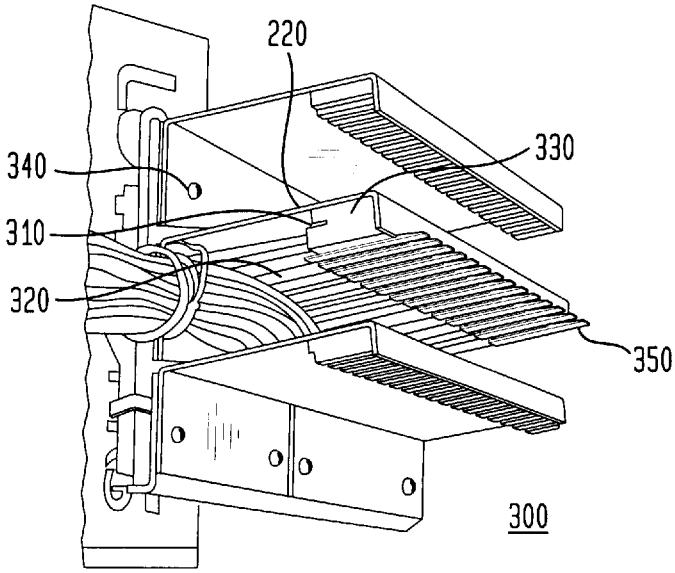
FIGS. 3(*a*)–3(*c*) show multiple perspective views of the embodiment illustrated in FIG. 2.
Figure 3B:
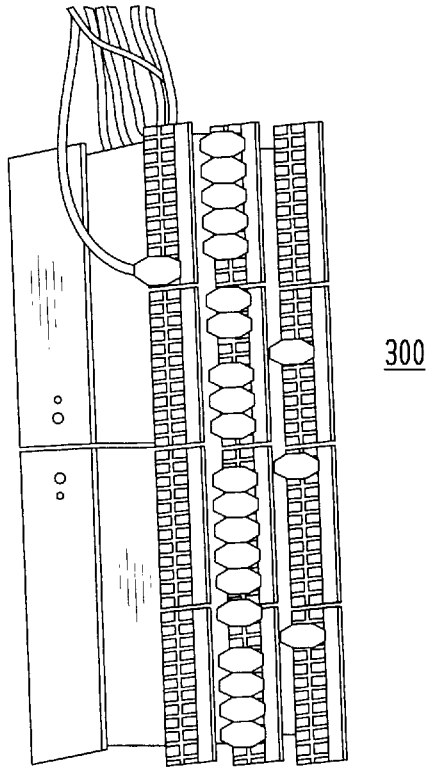
Figure 3C:
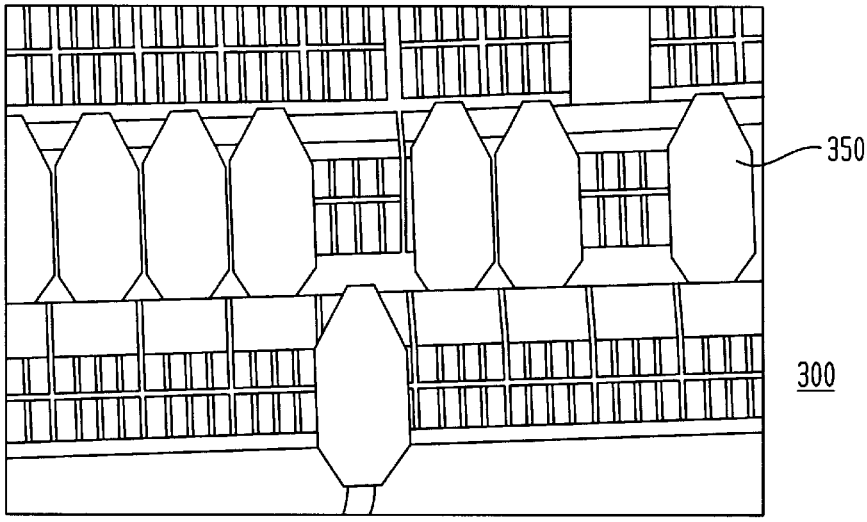

Specifically, FIG. 3(*a*) shows a perspective view of a cross connect system 300 with a mated plug and jack 310. The jack is connected to the board 220. When the plug mates with this jack, the cordage 320 exits away from label surface 330 and into a trough area 340. Such placement of cordage 320 of the mated plug and jack 310 provides a very neat appearance, and leaves the label surface 330 clearly viewable.

Referring now to FIG. 3(*b*), a bottom up view of FIG. 3(*a*) and FIG. 3(*c*) is shown and a close up view of mated plug and jack 310 is provided. As is shown in FIG. 3(*b*), the mated plug and jack 310 are connected to the board 220, with the cordage 320 exiting away from the label surface 330 and into the trough 340. This uniform exiting of the cordage 320 provides for a neat appearance with cordage only exiting one end of the board 220. Also, as is shown, the label surface 330 is not obstructed, except for the minor presence of the handle 350 of the mated plug and jack 310.

FIG. 3(*c*) also shows that label surface 330 is unobstructed except for the minor presence of handle 350 of mated plug and jack 310. Advantageously, an easy to read label surface is invaluable during cord tracing and other such activities.

Numerous modifications and alternative embodiments of the invention will be apparent to those skilled in the art in view of the foregoing description. In particular, the amount of printed wiring boards that are employed may be varied. Accordingly, this description is to be construed as illustrative only and is for the purpose of teaching those skilled in the art the best mode of carrying out the invention. Details of the structure may be varied substantially without departing from the spirit of the invention and the exclusive use of all modifications which will come within the scope of the appended claims is reserved.

What is claimed:

1. A building terminal cross connector system for selectively and removably connecting wire pairs for telecommunication services, said connector system comprising:

a first printed wiring board having a side edge;

a plurality of jacks attached to said first printed wiring board, each of said jacks having a first surface, wherein said jack includes at least two electrical terminals for connection to a first wire pair for telephone service; and a plurality of plugs, each plug having a handle, at least two electrical terminals for connection to a second wire pair for telephone service and a second surface, said second surface for engaging said first surface of a respective jack, wherein a fulcrum point is established at an engagement point of said first surface of said jack and said second surface of said plug, said plug being rotated about said fulcrum point by said handle until an electrical connection is established between said at least two terminals of said plug and said at least two terminals of said jack and a physical connection is achieved between said plug and said jack, upon said physical connection, said handle of said plug passing over said side edge of said first printed wiring board.

2. The connector system according to claim 1, wherein each jack of said plurality of jacks includes a label receiving surface.

3. The connector system according to claim 1, wherein each jack of said plurality of jacks includes at least eight electrical terminals for connection to four wire pairs for telephone service.

4. The connector system according to claim 3, wherein each jack of said plurality of jacks includes a plurality of sets of eight electrical terminals, each for connection to four wire pairs for telephone service, with each set of eight electrical terminals being separated by a partitioning wall from an adjacent set.

5. The connector system according to claim 1, further comprising:

a backplane connected to said first printed wiring board.

6. The connector system according to claim 5, wherein an angle exists between said first printed wiring board and said backplane.

7. The connector system according to claim 6, wherein said angle between said first printed wiring board and said backplane is approximately 90 degrees.

8. The connector system according to claim 6, further comprising:

a second printed wiring board connected to said backplane, said second printed wiring board extending parallel to said first printed wiring board.

9. The connector system according to claim 8, wherein a trough is formed adjacent said backplane and between said first and second printed wiring boards, such that wires connected to said plurality of plugs can pass along said trough.

10. The connector system according to claim 8, wherein said backplane is a third printed wiring board, and said first and second printed wiring boards are both physically and electrically connected to said third printed wiring board by first and second edge card connectors, respectively.

11. A connector system comprising:

a first printed wiring board having a side edge;

a jack attached to said first printed wiring board, said jack having a first surface; and a plug having a handle and a second surface, said second surface for engaging said first surface, wherein a fulcrum point is established at an engagement point of said first surface of said jack and said second surface of said plug, said plug being rotated about said fulcrum point until a connection is achieved between said plug and said jack, upon said connection, said handle of said plug passing over said side edge of said first printed wiring board, wherein said jack includes at least eight electrical terminals for connection to four wire pairs for telephone service, and wherein said jack includes a plurality of sets of eight electrical terminals, each for connection to four wire pairs for telephone service, with each set of eight electrical terminals being separated by a partitioning wall from an adjacent set.

* * * * *